US005532801A

United States Patent [19]

Mizoguchi

[11] Patent Number: 5,532,801

[45] Date of Patent: Jul. 2, 1996

[54] IMAGE FORMING METHOD SUPERPOSING FIRST AND SECOND DEVELOPING OPERATIONS ON AN IMAGE BEARING MEMBER

[75] Inventor: Yoshito Mizoguchi, Kawasaki, Japan

[73] Assignee: Canon Kabushiki Kaisha, Tokyo, Japan

[21] Appl. No.: 363,885

[22] Filed: Dec. 27, 1994

[30] Foreign Application Priority Data

Dec. 27, 1993 [JP] Japan ..... 5-348362

[51] Int. Cl.[6] ..... G03G 15/08

[52] U.S. Cl. ..... 355/246; 430/45; 355/326 R

[58] Field of Search ..... 430/45; 355/246, 355/265, 326 R, 327

[56] References Cited

U.S. PATENT DOCUMENTS 5,066,979 11/1991 Goto et al. ..... 355/208
5,187,535 2/1993 Tajima ..... 355/326 R
5,418,097 5/1995 Furuya et al. ..... 430/42 X

FOREIGN PATENT DOCUMENTS 55-137538 10/1980 Japan .
277767 3/1990 Japan .

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

An image forming method includes forming a first electrostatic image on an image bearing member; developing with developer carried on a developer carrying member the first image formed in the first image forming step; forming a second electrostatic image on the image bearing member carrying the first developed image formed in the first developing step; and developing with developer carried on a developer carrying member, the electrostatic image formed in the second electrostatic image forming step; wherein during the second developing step, an alternating electric field is generated between the developer carrying member and the image bearing member, and a time period T(1-2) necessary for the electric field to shift from a peak value V1 of a transfer portion, which transfers developer to the image bearing member, to a peak value V2 of a back-transfer portion, which transfers developer back from the image bearing member to the developer carrying member, is larger than a time period T(2-1) necessary for the electric field to shift from V2 to V1.

5 Claims, 6 Drawing Sheets

IMAGE FORMING METHOD SUPERPOSING FIRST AND SECOND DEVELOPING OPERATIONS ON AN IMAGE BEARING MEMBER

FIELD OF THE INVENTION AND RELATED ART

The present invention relates to an image forming method for superposing two or more images, and in particular, to an image forming method for superposedly forming two or more developed images on an image bearing member. In recent years, a color image forming apparatus using two or more developers of different colors has become popular among the image forming apparatuses of electrophotographic or electrostatic recording systems, and in order to simplify the structure of such systems, it has been considered to superpose two or more toner images on a photosensitive member, and transfer these toner images onto recording medium simultaneously.

As for this process of superposing multiple toner images on the photosensitive drum, there are: a negative-negative process, in which two reversal developments are carried out; a negative-positive process proposed in Japanese Laid-Open Patent Application No. 137,538/1980; a three value (level) process proposed in Japanese Laid-Open Patent Application No. 81,855/1977; and the like.

However, these superposing methods according to the prior art are liable to disturb the first toner image or allow first toner from the first image to mix into the second developing device. As a countermeasure for such faults, it is known that a non-contact developing method is effective, in which the gap between the photosensitive drum and a toner carrying member, that is, the developer carrying member (S-D gap), is 100 μm to 500 μm, and the toner layer thickness is 50 μm to 200 μm. It also is known to use an alternating voltage as the development bias applied during the second image development operation, so that image quality is improved. In this case, the alternating voltage generates an electric field, which also works to strip the first toner from the photosensitive drum; therefore, the first toner gradually mixes into the second developing device, though the amount is small, and eventually, the first toner accumulated in the second developing device is liable to appear in the second toner image, causing color mixing.

FIG. 8(F) illustrates the relation between the surface potential of the photosensitive drum and the development bias during a second development operation, wherein a broken line designates the alternating bias for the second development operation. At this time, the electric field which develops the second latent image has a potential difference (a). On the other hand, as the stripping bias, a bias which strips the second toner is designated by a reference (b), and the bias which strips the first toner is designated by a reference (c), wherein (c)>(b), and therefore, the first toner is likely to be stripped from the photosensitive drum.

Regarding this kind of first toner stripping, a method for reducing the potential difference (c) is proposed, for example, in Japanese Laid-Open Patent Application No. 77,767/1990, in which a so-called duty bias is employed as the alternating bias. In this method, the relation between the surface potential of the photosensitive drum and development bias is as shown in FIG. 8(F'), in which (c') is rendered smaller than (c), which is effective to prevent the toner stripping.

However, it has been discovered that even when a development bias is used with a reduced stripping bias portion, such as the one illustrated by the broken line in FIG. 8(F'), the first toner is still stripped and mixed into the second developing device, though the amount is very small.

SUMMARY OF THE INVENTION

Accordingly, a primary object of the present invention is to provide an image forming method capable of preventing the toner of one color from being mixed into a developing device containing toner of another color.

According to an aspect of the present invention, an image forming method comprises the steps of:

forming a first electrostatic image on an image bearing member;

developing with developer carried on a developer carrying member the first image formed in the first image forming step;

forming a second electrostatic image on the image bearing member carrying the first developed image formed in the first developing step; and developing with developer carried on a developer carrying member, the electrostatic image formed in the second electrostatic image forming step;

wherein during the second developing step, an alternating electric field is generated between the developer carrying member and the image bearing member, and a time period T(1-2) necessary for the electric field to shift from a peak value V1 of a transfer portion, which transfers the developer to the image bearing member, to a peak value V2 of a back-transfer portion, which transfers developer back from the image bearing member to the developer carrying member, is larger than a time period T(2-1) necessary for the electric field to shift from V2 to V1.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Below, embodiment examples of the present invention will be described with reference to the drawings.

Figure 9:
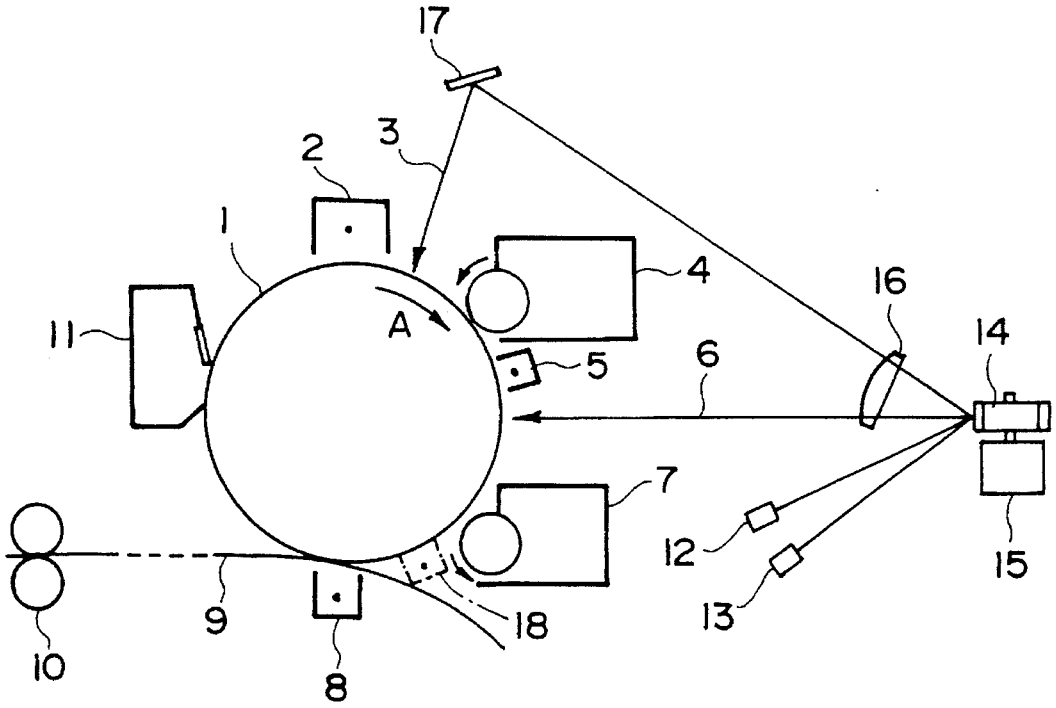
FIG. 9 is a schematic structural view of the two color image forming apparatus.

FIG. 9 is a schematic view of the essential portion of an embodiment of an image forming apparatus according to the present invention.

FIG. 8(A)–8(F) show the surface potential of an photosensitive drum as an electrostatic latent image bearing member of the apparatus illustrated in FIG. 9, in each step of the development process.

Figure 8A:
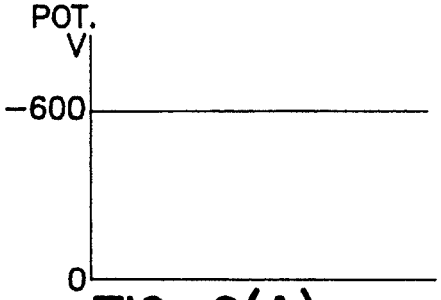
FIGS. 8(A) to 8(F) and 8(F)' explanatory drawings to describe a two color image forming process.
Figure 8B:
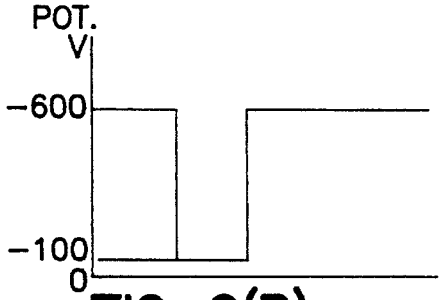

Referring to FIG. 9, the surface of a photosensitive drum 1 is provided with a photoconductive layer composed of organic photoconductor or the like, and its surface is uniformly charged by a primary charger 2 to, for example, a potential of −600 V as it is rotated in the direction of an arrow (FIG. 8(A)). A rotary polygon mirror 14 is rotated at a predetermined revolution by a motor 15, and deflects a laser beam projected from semiconductor lasers 12 and 13, which will be described later.

The first semiconductor laser 12 projects a first laser beam 3 which has been modulated by a first image signal. This first laser beam 3 is deflected by the rotary polygon mirror 14, is passed through an image forming lens 16, is deflected by a mirror 17, and then, is caused to raster-scan the surface of the photosensitive drum 1, whereby the potential of the surface area exposed by the laser beam is attenuated to, for example, a potential of −100 V. As a result, a first latent image is formed (FIG. 8(B)).

Figure 8C:
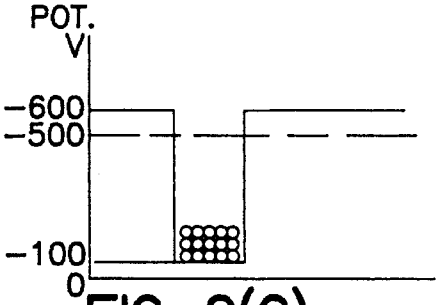
Figure 8D:
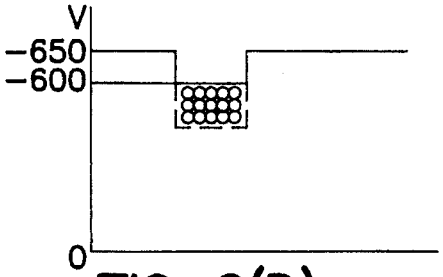
Figure 8E:
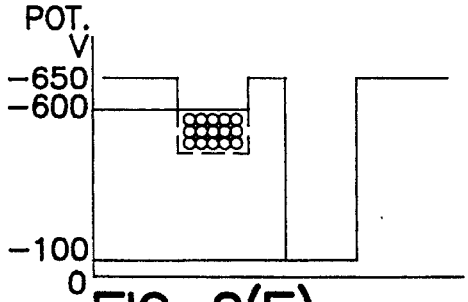

The first latent image is developed with two-component developer composed of negatively chargeable red toner and magnetic particles such as ferritc, using a first developing device 4; the first latent image is reverse developed by applying to the first developing device 4 a developing bias composed of a DC voltage (−500 V) and an AC voltage (1600 Hz, 1800 Vpp) superposed thereon (FIG. 8(C)). The toner image potential is increased approximately −100 V by the toner potential, to approximately −200 V.

The photosensitive drum 1 is recharged by recharger (second charger) 5, whereby the potential of the first toner image is increased. At this time, the potential of the first non-image portion is slightly increased. As for the potential after the recharge, it is approximately −650 V at the first non-image portion, and approximately −600 V at the first image portion (FIG. 8(D)).

The second semiconductor laser 13 projects a second laser beam 6, which has been modulated by a second image signal. This second laser beam 6 is deflected by the rotary polygon mirror 14, is passed through an image forming lens 16, is deflected by a mirror 17, and then, is caused to raster-scan the surface of the photosensitive drum 1, whereby the potential of the surface area exposed by the laser beam is attenuated to, for example, a potential of −100 V. As a result, a second latent image is formed (FIG. 8(E)).

Figure 8F:
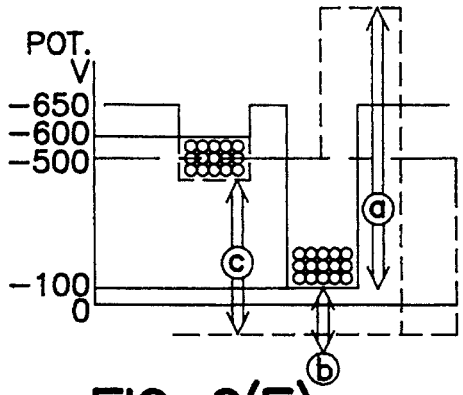
Figure 8F:
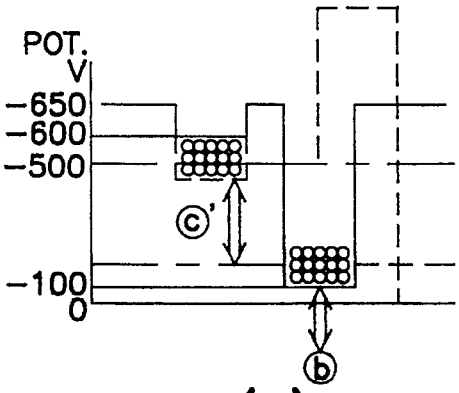

Thereafter, the second latent image is reverse developed by applying a second developing device 7 containing, for example, a negatively charged single component magnetic black toner, and a development bias composed of, for example, a DC voltage (−500 V) and an AC voltage (1600 Hz, 1300 Vpp) superimposed thereon (FIG. 8(F)).

Figure 1:
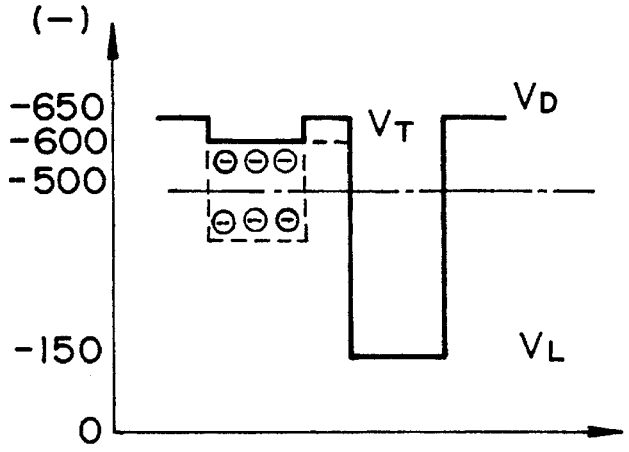
FIG. 1 is a schematic diagram of the surface potential of the photosensitive drum of a first embodiment of a developing device of a multi-color image forming apparatus according to the present invention.
Figure 2:
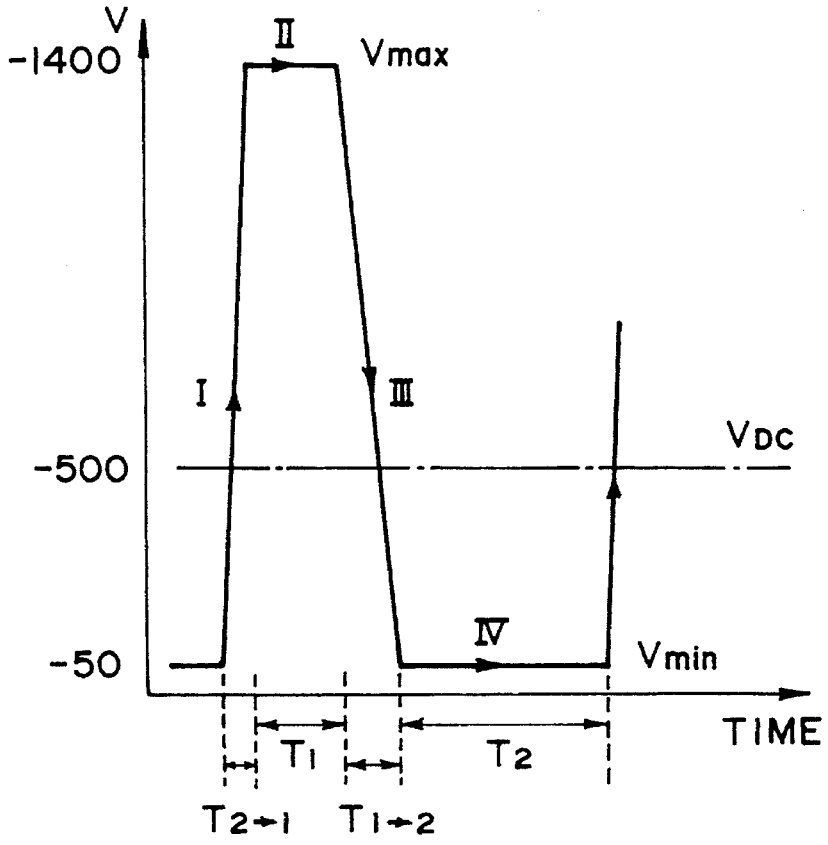
FIG. 2 is a graph of a second development bias employed for the first embodiment of the developing device in the multi-color image forming apparatus according to the present invention.

FIGS. 1 and 2 are a schematic diagram and graph, respectively, which best characterize the present invention, wherein FIG. 1 shows the surface potential of the photosensitive drum during the second development operation, and FIG. 2 shows the second development bias.

In FIG. 1, a reference $V_D$ designates a potential at an area, which has been the non-image portion during the first development, and is a non-image portion during the second development operation after the recharge; $V_T$ designates a potential at an area which has been the image portion during the first development, but is a non-image portion during the second development operation after the recharge: and $V_L$ is a potential of the image portion during the second development.

In FIG. 2, the development bias to be applied to the second developing device is shown. It is an alternating voltage and chronologically changes as indicated by arrows.

A reference Vmax designates a peak bias for developing the image portion $V_L$ during the second development, and is referred to as transfer voltage. A reference Vmin designates the peak of a back-transfer portion of the development bias, and is called back-transfer voltage. A single dot chain line designates the effective value of the DC component of this alternating voltage, and is designated by a reference $V_{DC}$. The duration of Vmax in one cycle of the alternating voltage is designated by a reference T1, and the duration of Vmin is designated by a reference T2.

A reference T(1-2) designates the time necessary for the bias to change from Vmax to Vmin, and T(2-1) designates the time necessary for the bias to change from Vmin to Vmax.

The inventors of the present invention studied the relation between T(1-2) and T(2-1) and made the following discovery; when the time necessary for the development bias to change from the transfer voltage to back-transfer voltage was extended, in relative terms, that is, when the rate of bias change per unit time at which the development bias changes from the transfer voltage to the back-transfer voltage was reduced, the first toner was prevented from being stripped from the photosensitive drum and mixed into the second developing device. In other words, the inventors thereby discovered that when the relation among T1, T2, T(1-2) and T(2-1) was properly set up, a development bias, which could prevent the above toner mix-up while securing a sufficient image density and preventing fog could be obtained.

The reason why the mix-up can be prevented has not been clearly determined. One of the possible answers is as follows; the toner with high responsivity to the electric field change (for example, toner with a high triboelectric charge) is liable to respond sensitively to the alternating electric field, being easily stripped, and this response can be impeded as the wave-form of the bias is rendered gentler. However, when the bias wave-form is simply dulled across its entire configuration, sufficient density cannot be obtained, and fog cannot be eliminated.

Thus, in this embodiment, in order to prevent the first toner from being stripped, either the rising or falling portion of the bias wave-form is rendered gentler so that a bias wave-form, which can prevent the toner mix-up while securing sufficient image density and removing fog, can be provided.

Next, referring to FIG. 2, the chronological bias change will be described. A period I corresponds to the rising portion of the bias wave-form, wherein, since Vmax is the bias for developing the image portion $V_L$, the wave-form is given a sharp angle. This arrangement is made to provide enough energy to cause even toner with a strong force to adhere to the sleeve, such as toner with a high triboelectric charge, to jump from the sleeve surface.

Next, toner is also jumped during a period II, and when this period is short, it inevitably results in under-development, which brings forth low image density.

A next period III corresponds to the falling portion of the bias wave-form, wherein the bias voltage drops to Vmin, and remains there during a period IV, in which excessive toner adhering to the image portion $V_L$ or fog generating toner adhering to the non-image portion is stripped. Needless to say, when the period IV is short, fog cannot be sufficiently eliminated.

Since the first toner in this embodiment has the same polarity as the second toner, it is also affected by the stripping force in the periods III and IV. Therefore, when the bias wave-form in the period III drops at an angle equivalent to that in period I, the first toner is stripped and mixed into the second developing device, though the amount is slight. As for the reason for this phenomenon, the following is conceivable; the first toner with a high triboelectric charge, which has adhered to the surface of the photosensitive drum during the first development, is charged higher through the recharge, and as a result, this toner with a high triboelectric charge, which has turned into a toner with higher triboelectric charge, jumps from the drum in response to the sharp bias change, and mixes into the second developing device during the periods III and IV.

On the contrary, it was discovered that when the bias was gently dropped to Vmin in the period III as described before, the first toner was prevented from mixing with toner in the second developing device. As for the reason for this effect, the following is conceivable; since the stripping force in the period III became gentler, the toner with a higher triboelectric charge was not sufficiently affected to be stripped from the drum in the period III, and remained adhered to the drum due to the reflection force in period IV. However, even though extending T(1-2) is effective to prevent toner mix-up, it renders T1, T2 and/or T(2-1) shorter, provided that the frequency is fixed. As described before, when T1 corresponding to the jumping portion of the second development bias wave-form is short, the image density is reduced, and when T2 is excessively short, fog is not sufficiently removed, deteriorating the image quality of the second image.

Thus, it is preferable to set up the relation among T1, T2, T(1-2) and T(2-1) to satisfy the following formulas:

$$T(1\text{-}2)>T(2\text{-}1)$$

and more preferably, in addition to the above formula:

$$T1>T(1\text{-}2)$$

$$T2>T(2\text{-}1)$$

so that sufficient time is provided for development and toner removal.

On the other hand, when the frequency is reduced, T1 and T2 can be rendered sufficiently long even if T(1-2) is extended. However, this is not preferable since such an arrangement reduces the effects of the alternating bias in the first place. On the other hand, when the frequency is excessively increased, toner cannot respond to the high frequency, which also is not preferable. Therefore, the frequency is preferred to be within a range from 1.0 kHz to 8.0 kHz.

Up to now, the relation among the wave-form, rise time, and falling or drop time of the bias has been described. As for the magnitudes of Vmax, Vmin, and $V_{DC}$ when they are set up so as to render such a duty bias as disclosed in the aforementioned Japanese Laid-Open Patent Application No. 77767/1990 and shown in FIG. 2, the toner mix-up can be more effectively prevented.

In other words, when the bias is rendered as such a bias as to satisfy the following formula:

$$|Vmax-V_{DC}|>|Vmin-V_{DC}|$$

$|Vmin-V_T|$ can be maintained at a low level, while preventing the first toner mix-up, and increasing $|Vmax-V_L|$ to develop sufficiently the second image. As for the duty ratio in this case, a ratio within a range of 0.1–0.4 is preferable to enhance the effects of the duty bias.

Below, the effect of this embodiment will be described with reference to experiments.

Experiment 1

An organic photoconductive material, the sensitivity peak of which was in the infrared range, was used as the material for the photosensitive layer of the photosensitive drum. The photosensitive drum was uniformly charged to a potential of −600 V, and was exposed to a laser beam having been modulated digitally by an image forming signal, whereby a first latent image was formed on the photosensitive drum.

When an original was read for the exposure, a color separating filter was placed on a CCD sensor to separate the image of the original into three primary color images of the original, and the color of each picture element was discriminated, wherein in this experiment, the red color was designated as the first color, and the black as the second. Referring to FIG. 9, a developing device 4 is the color developing device, and a developing device 7 is the black developing device. The first latent image was developed with the developing device 4, and then, was recharged with a recharger 5, whereby the potential of the first image portion (portion where the color toner has adhered) reached approximately −600 V, and the potential of the first non-image portion reached approximately −650 V. Next, the second exposure was carried out, and the second image portion was developed by the developing device 7.

Figure 3:
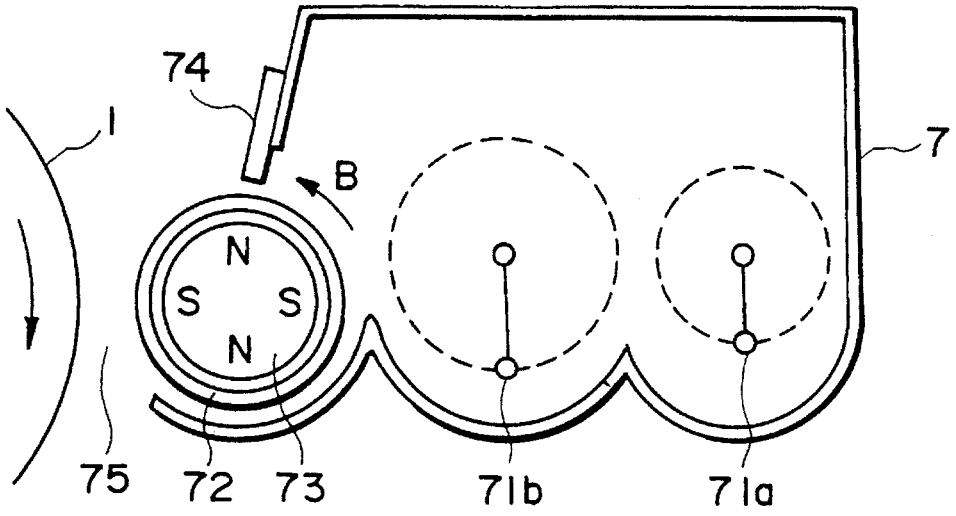
FIG. 3 is a schematic structural view of a second developing device employed in the first experiment of the first embodiment.

The developing device 7 illustrated in FIG. 3 contained a magnetic toner (single component magnetic developer). The toner was stirred by stirring members 71*a* and 71*b*, and was supplied to a developing sleeve 72. The toner supplied to the developing sleeve 72 was carried on the developing sleeve 72 and delivered in the direction of an arrow B by a combination of the rotation of the developing sleeve 72 in the arrow B direction and the magnetic force of a magnet roller 73 disposed fixedly within the developing sleeve 72. Then, after being regulated by a developer regulating member 74, being thereby formed into a thin toner layer, the toner was delivered to a developing station 75, in which it came closest to the photosensitive drum 1.

Since the toner is dielectric, it is charged through friction between the toner and a non-magnetic developing sleeve 72. The charge polarity of the toner in the second developing device 7 is rendered negative in order to reverse develop the latent image (negative) on the photosensitive drum 1. The magnitude of the triboelectric charge of the toner is dependent on various factors such as toner composition, toner particle diameter, amount of charger controlling additive, surface properties of the developing sleeve 72, distance between the regulating member 74 and developing sleeve 72, and packing density of the toner (toner density). In this experiment, styrene-acrylic magnetic toner having an average particle diameter of 8 μm was employed, and a silica was admixed thereto to give fluidity.

The developing sleeve 72 was made of non-magnetic stainless steel, and its surface was blasted with glass beads of #400 or so. The regulating member 74 was made of non-magnetic stainless steel, and its thickness was 1.2 mm. The closest distance between the regulating member 74 and the developing sleeve 72 was 200 μm. At that time, the amount of the triboelectric charge was approximately 15–20 μC/g, and the toner thickness was approximately 0.8–1.2 mg/cm$^2$.

The magnet roller 73 was given four poles. The developing pole, which was the one disposed in the developing station 75 so as to face straight into the photosensitive drum 1, had a magnetic force of approximately 300–1200 Gauss, and thereby caused the toner to stand up, looking like a broom tip. With the toner being in the above condition, jumping development was carried out by the aforementioned alternating voltage. The closest distance between the developing sleeve 7 and photosensitive drum 1 was approximately 300 μm. They were rotated in the same direction, whereas the peripheral velocity of the developing sleeve was approximately 1.5 times that of the photosensitive drum 1.

The specifications of the development bias were; Vmax=−1400 V; Vmin=−50 V; $V_{DC}$=−500 V; frequency=2.0 kHz: T2=280 μsec; T(1-2)=70 μsec; (T2-1)=35 μsec; wherein T(1-2) was approximately two times (T2-1), and was shorter than both T1 and T2. When such a baas was applied to develop the second image, the stripping of the first toner could be prevented, and the quality of the image after the second development was satisfactory.

In order to confirm the above results, an endurance test was conducted, in which a first toner image developed by the first development and a second image developed by the second development had the same image ratio of 6%. Even after 10,000 copies were made, there was no toner mix-up in the second developing device. On the other hand, when a bias with a T(1-2) of 30 μsec and a T(2-1) of 30 μsec, that is, a bias which quickly rose and quickly dropped, was applied, a slight color toner mix-up was observed after an endurance test conducted under the same image ratio conditions.

It should be noted that an intensity (Emax) of the electric field generated during T1 to develop the area with the potential of $V_L$ was 4.17 V/μm (intensity Emin of the electric field generated to strip the toner from the $V_L$ area=0.33 V/μm), and an intensity ($E_T$) of the electric field generated during T2 to strip the toner from the $V_T$ area was 1.83 V/μm, as is evident from the diagram. $E_T$ was set as disclosed in the aforementioned Japanese Laid-Open Patent Application No. 77767/2990.

Experiment 2

Figure 4:
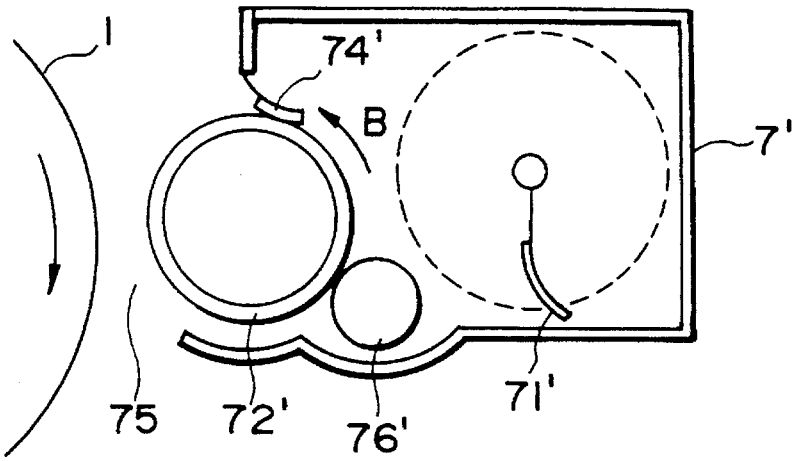
FIG. 4 is a schematic structural view of a second developing device employed in the second experiment of the first embodiment.

In this experiment, the latent images were formed under the same conditions as those in Experiment 1, and were developed with non-magnetic toner (single component non-magnetic developer), using the developing device 7 illustrated in FIG. 9, wherein the developing device 7 was structured as illustrated in FIG. 4.

A developing device 7' illustrated in FIG. 4 contained non-magnetic toner. The toner was supplied to a coating roller 76'; it was stirred by a stirring blade 71', and then was supplied to a developing sleeve 72' by the coating roller 76'. As the developing sleeve 72' rotated in the direction of arrow B, the toner was squeezed through the gap between the elastic blade 74' and the developing sleeve 72', being thereby triboelectrically charged, and adhered to the developing sleeve 72' due to the electrostatic mirror force. Then, as the developing sleeve further rotated, the toner was delivered to the developing station 75.

As the developing sleeve 72' further rotated, the toner, which had not been consumed in the developing station during development, was returned to the developing device 7', and was scraped off the developing sleeve 72' as it was rubbed by the coating roller 76'. At that time, the toner polarity was negative, as it was in the first experiment.

The elastic blade 74' was made of silicone rubber, and was extended in the direction countering the rotational direction of the developing sleeve, and was placed in contact with the developing sleeve 72', with a linear contact pressure of 15–20 g/cm. As for the toner contained in the developing device 7', styrene-acrylic non-magnetic toner having an average diameter of 8 μm was used. It was colored with carbon black, and silica was admixed therein to give fluidity.

The triboelectric charge was approximately 25–30 μC/g, and the toner layer thickness was approximately 0.4–0.8 mg/cm$^2$. The triboelectric charge in this experiment was higher than that of the magnetic toner in the first embodiment, that is, 15–20 μC/g. This is because of the following reasons; in the case of magnetic toner, it can be attracted to the developing sleeve by magnetic force, creating little problem, whereas, in the case of non-magnetic toner, it is adhered to the developing sleeve by the electrostatic mirror force alone, and therefore, unless the amount of the charge is increased to strengthen the electrostatic mirror force, the toner too easily jumps to the photosensitive drum 1, being liable to create fog.

The above developing device was disposed so that the gap between the photosensitive drum 1 and developing sleeve 72' was approximately 280 μm, and the developing sleeve 72' was rotated in the same direction as the photosensitive drum 1, at a peripheral velocity of approximately 1.5 times that of the photosensitive drum 1.

Figure 5:
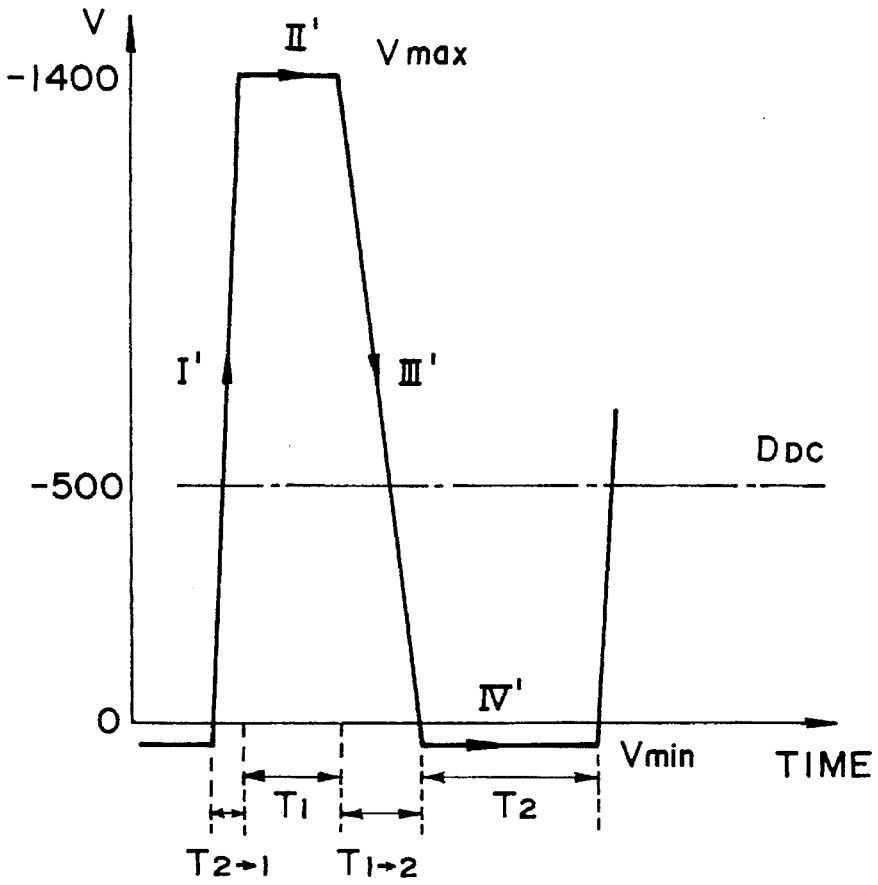
FIG. 5 is a graph of the second development bias employed in the second experiment of the first embodiment.

As for the development bias, the one shown in FIG. 5 was applied in place of the one shown in FIG. 2, which was employed in Experiment 1, wherein Vmax and $V_{DC}$ were the same as those shown in FIG. 2, whereas the Vmin was 100 V lower. Describing the bias wave-form in chronological order, the periods I'–II' were the same as those the first experiment.

In period III, the bias of this experiment was allowed to change gentler from Vmax to Vmin in comparison with the Experiment 1. In other words, the length of this period was 1.5 times that in Experiment 1, and the amount of the stripped first toner was further reduced. The extension of the period III did shorten the length of IV, but since the triboelectric charge of the second toner in this experiment was higher than that in Experiment 1, its responsivity to the AC bias was better; therefore, the fog removing effect was not reduced in spite of the shorter IV period. However, since the toner was not magnetic, it could not be magnetically stripped; therefore, Vmin was reduced as a countermeasure. Further, since the high triboelectric charge strengthens the electrostatic mirror force, and the strengthened electrostatic mirror force impedes the toner from jumping from the developing sleeve, the closest distance between the developing sleeve 72' and photosensitive drum 1 was set to be less than that in Experiment 1. In other words, the electric field intensity was raised in practical terms, and therefore, the second development operation could give satisfactory density. Further, in this experiment, T1, T(1-2), T2 were rendered slightly longer so as to secure proper density.

In Experiment 2, Emax=4.46 V/μm; Emin=0.71 V/μm; and $E_T$=2.32 V/μm, wherein $E_T$ was rendered slightly larger than the electric field intensity 2.3 V/μm disclosed in the aforementioned Japanese Laid-Open Patent Application No. 77767/1990. However, since the inclination of the wave-form in T(1-2) was rendered gentler, the first toner was not stripped.

Next, referring to FIGS. 6 and 7, another embodiment will be described.

Figure 6:
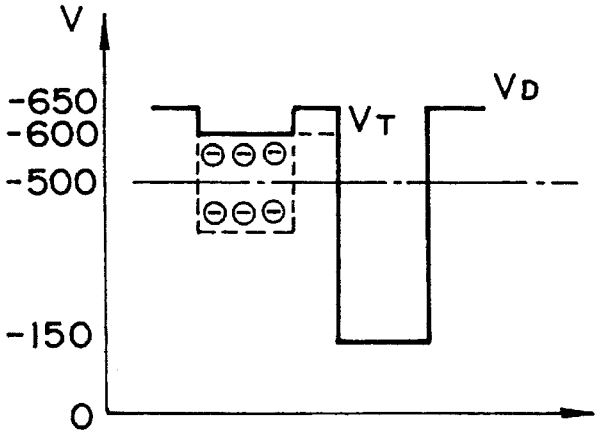
FIG. 6 is a schematic diagram showing the surface potential of the photosensitive member of the second embodiment of the developing device according to the present invention.
Figure 7:
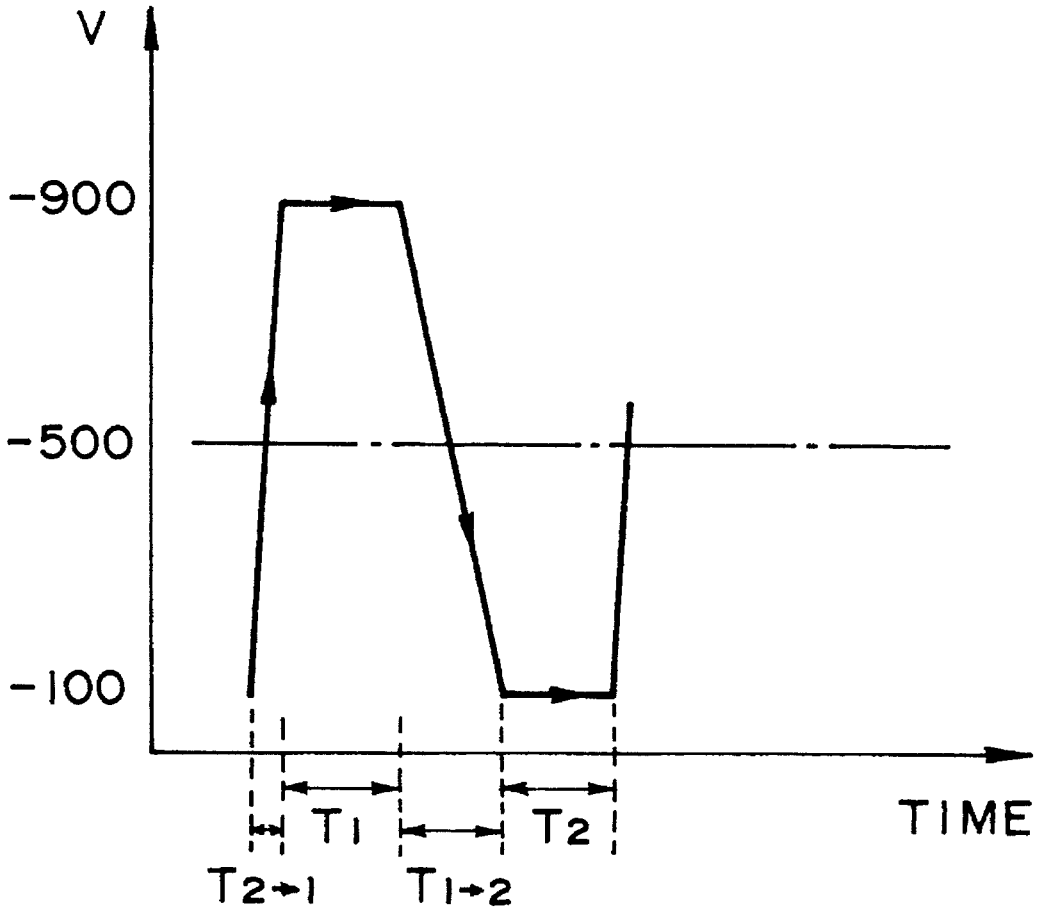
FIG. 7 is a graph of the second development bias employed in the second embodiment of the developing device according to the present invention.

FIG. 6 shows the potential of the photosensitive member during the second development operation, which is the same as the one illustrated in FIG. 1. FIG. 7 shows the bias to be applied to the second developing device, and this bias is not provided with a duty such as the one depicted in FIG. 2 or 5.

The image forming apparatus employed in this embodiment was the same as the one shown in FIG. 9. The developing device was the same as the one described with reference to FIG. 4, and the closest distance (S-D gap) between the developing sleeve and photosensitive drum was 180 μm.

The electric field strength (Emax) generated during T1 for developing the $V_L$ area was: Emax=4.17 V/μm; and the electric field strength (Emin) generated for stripping the toner from the $V_L$ area was: Emin=0.28 V/μm. In other words, the second development was carried out using approximately the same electric field strength as described before; therefore, the density was about the same.

On the other hand, $E_T$=2.78 V/μm, which was higher than the one disclosed in the aforementioned Japanese Laid-Open Patent Application No. 77767/1990, but it was confirmed that there was no stripping of the first toner. This is thought to be because of the following reason; since the peak-to-peak value of the bias wave-form was small, it was possible to reduce further the rate of bias change during T(1-2), and therefore, toner stripping was impeded even though $E_T$ was larger than that of the first embodiment.

Also in this connection, the rate of bias change in T(1-2) was 19.3 V/μsec in Experiment 1 of the first embodiment, and 13.8 V/μsec, that is, approximately ⅔ times the one in Experiment 1, in Experiment 2, whereas in this embodiment, it was 6.7 V/μsec, which was an extremely small inclination. Therefore, it is conceivable that toner stripping was reduced in spite of the slightly larger $E_T$. This rate of bias change drastically changes in response to the parameter of the second development such as peak-to-peak voltage (Vpp), frequency (f), and duty ratio. However, according to the comparative experiments in Experiment 1 of the first embodiment, it is preferable to keep the rate of bias change below 50 V/μsec.

When the rate of bias change during the T(1-2) is reduced, for example, by narrowing the S-D gap and reducing Vpp as described in this embodiment, the stripping of the first toner can be prevented even if the bias wave-form is not necessarily the one provided with the duty. Therefore, it is possible to reduce the cost of the high voltage transformer. However, the S-D gap is excessively small, and the first toner is more liable to be disturbed by contact.

The above descriptions of the second development have been given with reference to development using the single component developer, but the present invention is applicable to any developing apparatus in which two component developer is used and an alternating bias is applied.

It is needless to say that when the two component developer is used, the thickness of the developer layer on the developing sleeve increases; therefore, it is preferable to increase the S-D gap to 500–1000 μm, and accordingly, to increase the peak-to-peak voltage.

Further, in the above examples, a color image formation process based on two primary colors was described with reference to a so-called negative-negative recharging system, but the present invention is also applicable when two toners with different polarity are used, for example, when a negative-positive process is used. In such a case, it is only necessary to lengthen the voltage shifting time in such a manner that the inclination of the bias voltage wave-form is decreased at a portion where the bias voltage works in the direction to strip the first toner from the photosensitive member.

Further, the present invention is applicable not only to a two color development process, but also, to a multi-color development process in which multiple color images are formed on the photosensitive drum in a superposing manner.

While the invention has been described with reference to the structures disclosed herein, it is not confined to the details set forth and this application is intended to cover such modifications or changes as may come within the purposes of the improvements or the scope of the following claims.

What is claimed is:

1. An image forming method comprises steps of:

forming a first electrostatic image on an image bearing member;

developing with developer carried on a developer carrying member the first image formed in the first image forming step;

forming a second electrostatic image on the image bearing member carrying the first developed image formed in the first developing step; and developing with developer carried on a developer carrying member, the electrostatic image formed in the second electrostatic image forming step;

wherein during the second developing step, an alternating electric field is generated between the developer carrying member and the image bearing member, wherein the electric field has a peak value V1 at a transfer portion, which transfers developer to the image bearing member and is maintained for a predetermined time T1, a peak value V2 at a back-transfer portion, which transfers developer back from the image bearing member to the developer carrying member and is maintained for a predetermined time T2, wherein a time period T(1-2) necessary for the electric field to shift from a peak value V1 to a peak value V2 is larger than a time period T(2-1) necessary for the electric field to shift from a peak value V2 to a peak value V1; and wherein $|V1-V2|/T(2\text{-}1)<50$ V/μsec.

2. An image forming method according to claim 1, wherein T1>T(1-2), and T2>T(2-1).

3. An image forming method according to claim 1, wherein said second electrostatic image forming step comprises charging the image bearing member bearing the first developed image, and a relation between a potential $V_T$ of an image portion of the first developed image borne on the charged image bearing member and a shortest distance between said developer carrying member and image bearing member is:

$$|V_T-V2|/d<2.3\ V/\mu m.$$

4. An image forming method according to claim 1, wherein said image bearing member comprises a photosensitive layer; each of said first and second electrostatic image forming steps comprises charging said image bearing member and exposing said image bearing member; and said image bearing member is reverse developed in said first and second developing steps.

5. An image forming method according to claim 1, further comprising the step of transferring together the first and second developed images borne on said image bearing member onto recording medium.

* * * * *

UNITED STATES PATENT AND TRADEMARK OFFICE

CERTIFICATE OF CORRECTION

PATENT NO. : 5,532,801

DATED : July 2, 1996

INVENTOR(S) : Yoshito MIZOGUCHI

It is certified that error appears in the above-indentified patent and that said Letters Patent is hereby corrected as shown below:

COLUMN 3:

Line 4, "explanatory" should read --are explanatory--.

Line 17, "FIG." should read --FIGS.--.

Line 42, "ferritc," should read --ferrite,--.

COLUMN 7:

Line 61, "77767/2990" should read --77767/1990--.

COLUMN 10:

Line 51, "steps" should read --the steps--.

COLUMN 12:

Line 18, "recording" should read --a recording--.

Signed and Sealed this

Fourteenth Day of January, 1997

Bruce Lehman

*Attest:*

BRUCE LEHMAN

*Attesting Officer*

*Commissioner of Patents and Trademarks*